US009463616B2

(12) United States Patent
Domeier et al.

(10) Patent No.: US 9,463,616 B2
(45) Date of Patent: Oct. 11, 2016

(54) DEVICE AND METHOD FOR PRINTING ON CONTAINERS

(71) Applicant: KRONES AG, Neutraubling (DE)

(72) Inventors: Bernhard Domeier, Hohengebraching (DE); Viktor Gette, Obertraubling (DE); Andreas Sonnauer, Wörth (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/450,911

(22) Filed: Aug. 4, 2014

(65) Prior Publication Data

US 2015/0059601 A1 Mar. 5, 2015

(30) Foreign Application Priority Data

Sep. 4, 2013 (DE) ..... 10 2013 217 669

(51) Int. Cl.
*B41F 17/00* (2006.01)
*B41J 3/407* (2006.01)
*B41F 13/06* (2006.01)

(52) U.S. Cl.
CPC ..... *B41F 17/006* (2013.01); *B41F 13/06* (2013.01); *B41J 3/4073* (2013.01)

(58) Field of Classification Search
None
See application file for complete search history.

(56) References Cited

U.S. PATENT DOCUMENTS

| | | | |
|---|---|---|---|
| 5,029,523 A | 7/1991 | Fields | |
| 2004/0252174 A1 | 12/2004 | Baxter et al. | |
| 2010/0257819 A1* | 10/2010 | Schach | 53/411 |

FOREIGN PATENT DOCUMENTS

| | | |
|---|---|---|
| DE | 102009058212 A1 | 6/2011 |
| DE | 102011112300 A1 | 3/2013 |
| WO | WO-03/002349 A2 | 1/2003 |

OTHER PUBLICATIONS

Search Report, European Application No. 14180297.5, dated Feb. 26, 2015.
German Search Report for German Application No. 102013217669.4, dated Mar. 27, 2014.
English Translation of a Notification of First Examination Opinion for Chinese Application No. 2014104496985.

* cited by examiner

*Primary Examiner* — Justin Seo
(74) *Attorney, Agent, or Firm* — Marshall, Gerstein & Borun LLP

(57) ABSTRACT

A device for printing on containers, in particular non-rotationally symmetric containers, including at least one printing unit including at least one print head, a conveying system, which includes a plurality of container reception means arranged for rotation about axes of rotation and which is configured such that the container reception components circulate on a closed path and a print area of an outer surface of a container accommodated in a container reception components is movable past the print head, and at least one first drive adapted to rotate the container reception component, accommodating the container, about its axis of rotation by at least one open-loop and/or closed-loop control unit, the first drive being adapted to be variably controlled such that the print area is moved past the print head at a predetermined, substantially constant printing distance.

16 Claims, 6 Drawing Sheets

DEVICE AND METHOD FOR PRINTING ON CONTAINERS

CROSS-REFERENCE TO RELATED APPLICATION

The present application claims priority to German Application No. 102013217669.4, filed Sep. 4, 2013. The priority application, DE 102013217669.4, is hereby incorporated by reference.

FIELD OF THE INVENTION

The present invention relates to a device and a method for printing a preferably multi-colored print image on containers, in particular non-rotationally symmetric containers, in particular bottles or cans.

PRIOR ART

Containers for products, such as liquid food, sanitary articles and the like, are provided with an imprint for identifying the product and/or for high-quality product presentation. The imprint may be applied either directly to a print area on an outer wall of a container (direct print) or to a label as an additional print. The print color or printing ink is applied by means of one or a plurality of print heads directly to the outer surface of the container or the label. The printed print image may comprise e.g. characters, logos, patterns and color gradients. In addition, the print image may be single-colored or multi-colored. In the case of multi-colored print images, separate print heads are often provided for the individual print colors, print heads applying the respective print color according to the inkjet method to the print area. After the application of each individual print color, the latter can be fixed e.g. through drying by means of hot air, infrared radiation, UV radiation, microwaves, electron beams and the like. Alternatively thereto, the multi-color print image can be produced by means of one or a plurality of print heads according to the "wet in wet printing" principle in a single printing process and can be fixed subsequently.

Methods carried out according to the inkjet principle have in common that the quality of the print image vitally depends on the distance of the print head from the surface to be printed on and on the speed with which the surface to be printed on is moved past the print head during the printing process. For example, part of the printing ink applied according to the inkjet principle does not arrive at the outer surface area of the container to be treated but escapes into the ambient air as an aerosol of finely dispersed printing ink particles. Subsequently, the printing ink particles deposit from the aerosol onto the print area, among other areas, in an uncontrolled manner, thus causing smearing of the printing ink as well faults in or a degradation of the print image. The larger the printing distance, i.e. the distance between the print head and the respective surface element of the print area to be printed on, the more print color or printing ink will escape into the ambient air. It should therefore be aimed at to keep the printing distance constantly small during the entire printing process.

In addition, especially in the case of multi-color print images, it will be of advantage to move the print area to be printed on past the print head with a surface speed that should be as constant as possible, so that a uniform distance between the printed dots applied is obtained. A uniform surface speed provides a uniform resolution of the print image produced.

The prior art discloses methods in the case of which round containers, e.g. bottles, are rotated about their axis of rotation so as to establish a relative speed between the surface to be printed on and the print head. Likewise, methods are known, according to which containers having the shape of a cuboid or being, quite generally, not rotationally symmetric, are moved past the respective print head, e.g. by means of a linear machine or a carousel, the print head being then normally stationary.

In the case of containers having a non-rotationally symmetric base and especially in the case of print areas to be printed on that are neither flat nor configured such that they correspond to a cylinder segment or a cone segment, variations in the printing distance and/or the surface speed that may be substantial in some cases occur during the printing process according to the above methods. These variations have a substantial influence on the quality of the print image produced. Especially in the field of personal care, many containers are, however, configured with e.g. an oval base, such containers being therefore ill suited for being printed on by means of an inkjet. Also more complex shapes of the outer surface of the container to be printed on are imaginable, such as print areas that are concave with respect to the outer surface of the container or partially flat and partially curved as well as print areas having elongate oval cross-sections and the like. For many of these shapes neither a constant printing distance nor a constant surface speed can be realized due to the varying radius of curvature.

SUMMARY

It is therefore the object of the present disclosure to provide a device and a method for printing on containers, in particular non-rotationally symmetric containers, in the case of which a substantially constant printing distance can be guaranteed during the whole printing process. In addition, the device according to the present disclosure and the method according to the present disclosure aim at allowing a substantially constant surface speed of the surface to be printed on. More generally, it is the object of the present disclosure to improve the quality of print images applied to containers having a complex cross-section and to increase the throughput of a device for printing on such containers.

The above mentioned objects are achieved by a device for printing on containers, in particular non-rotationally symmetric containers, including:

at least one printing unit including at least one print head;

a conveying system, which includes a plurality of container reception means arranged for rotation about axes of rotation and which is configured such that the container reception means circulate on a closed path and a print area of an outer surface of a container accommodated in a container reception means is movable past the print head; and at least one first drive adapted to rotate the container reception means accommodating the container about its axis of rotation by means of at least one open-loop and/or closed-loop control unit, the drive being adapted to be variably controlled such that the print area is moved past the print head at a predetermined, substantially constant printing distance.

The device according to the present disclosure is suitable e.g. for printing on print areas, i.e. segments of the outer surface of a container to be printed on, that are convex or concave with respect to the outer surface of the container, and in particular for printing on print areas whose cross-section parallel to the container base is part of an oval. Normally, the shape of the cross-section of the print area corresponds to the shape of the container base. The invention is, however, not limited to printing on such containers, but allows also printing on containers in the case of which the shape of the print area to be printed on deviates from the shape of the container base. This is e.g. the case with tapering or round-bodied containers and containers having offset, in particular recessed, surface areas in the field of cosmetic and sanitary products. More generally, the invention is applicable for printing on print areas on containers of arbitrary shape, as long as the cross-section of the print area parallel to the base of the container can be parameterized with a continuously differentiable function. Deviations from the parameterized shape within normal manufacturing tolerances are allowed.

Containers within the meaning of the present disclosure are especially packaging means configured as containers and used for products to be filled thereinto, such as beverages, cosmetic products, sanitary products and the like, and in particular bottles or bottle-like containers or cans or can-like containers. Print colors or printing inks within the meaning of the present invention are colors or inks, in particular those in a liquid or slightly viscous form, that can be processed with print heads, which are preferably digitally controllable and which operate according to the inkjet printing principle.

The at least one print head includes a plurality of printing nozzles or openings for ejecting the print color or printing ink, which are arranged e.g. in a row and adapted to be individually electrically controlled for ejecting the print color or printing ink and which, to this end, are provided with a pressure-generating element, e.g. in the form of an electrode or a piezo element, at the respective nozzle opening. In addition, the print head may be configured such that it is tiltable within predetermined angular ranges with respect to a first axis (longitudinal axis) perpendicular to the discharge direction of the print color or printing ink and/or with respect to a second axis (transverse axis) perpendicular to the discharge direction of the print color or printing ink, the respective tilting angle being adaptable by means of the at least one open-loop and/or closed-loop control unit such that the discharged inkjet impinges as perpendicularly as possible on the respective surface element of the print area to be printed on.

The conveying system may be configured as a carousel, on which the rotatably arranged container reception means circulate on a circular path, or as an endlessly circulating driven conveying system that defines a closed loop. The latter may especially comprise a substantially linear conveying path, which leads past the printing unit. When configured as a carousel, the conveying system may be driven like a rotor, whereas conveyor belts, conveyor chains and/or linear motors may be used for driving the container reception means along the conveying system defining the closed loop. Linear motors allow, in an advantageous manner, the container reception means to be driven individually with a flexibly controllable speed along the conveying path of the conveying system.

The conveying system comprises a plurality of container reception means, which are arranged for rotation about axes of rotation and which may be configured for fixing the containers at the container bottom and/or at the container opening. The container reception means may e.g. be configured as container plates. The container reception means may be arranged along regular angular segments on a carousel or at regular intervals along the closed path. When a linear motor is used, a flexible arrangement of the container reception means is imaginable as well. The container reception means may be configured for receiving the containers from an infeed star wheel and conveying them along the circumference of the conveying system and transfer them, after the treatment including the printing process, to a discharge star wheel. The treatment of the containers may comprise, in addition to printing, in particular the curing of the print image as well as the application of a sealing or cover layer. The conveying system may be arranged in a beverage processing plant, in particular as part of a container treatment device. The container treatment device may be arranged downstream of a filling plant for filling a product into the containers. The container treatment device may also be arranged directly downstream of a stretch blow molding machine for PET bottles.

The printing unit comprising the at least one print head and the conveying system are arranged relative to one another such that the container reception means are moved past the at least one print head while circulating on the closed path. To this end, the printing unit may be arranged e.g. in the periphery of the conveying system, i.e. on the outer circumference of the closed path. In particular, the printing unit may be configured as a stationary component, i.e. such that it cannot be moved relative to a footprint of the device. Feed elements for the printing process, e.g. print colors or printing inks, may thus be configured as solid and therefore cost-efficient elements. It goes without saying that the device according to the present invention may comprise a plurality of printing units, in particular those used for applying a respective single print color, which may be arranged in succession along the circumference of the closed path. Two respective successive printing units may have arranged between them a curing station for fixing the respective print color applied and/or the sealing or cover layer.

The container reception means are configured such that they are rotatable separately and independently of one another about a respective axis of rotation of their own, said axis of rotation in general being oriented perpendicular to a plane defined by the closed path. The respective axis of rotation may be arranged centrically or eccentrically relative to the container reception means itself and/or the container to be accommodated therein. Even an axis of rotation outside of the container reception means is imaginable, the container reception means being then rotatable in its entirety about the respective axis of rotation. The container reception means may especially be configured such that the container reception means itself and/or the container accommodated therein can be displaced relative to the respective axis of rotation so as to allow printing on containers of different diameters and/or circumferences. The container reception means and/or the container may be displaced e.g. by means of a linear shaft and an electronically controllable servomotor. The distance between the center of area of the normally circular container reception means and the respective axis of rotation and/or the distance between the center of area of the base of the respective accommodated containers and the respective axis of rotation can here be adapted automatically by means of the open-loop and/or closed-loop control unit when a change of products takes place. The adaptation can be executed on the basis of one or a plurality of parameters stored in a memory unit of the open-loop and/or closed-loop control unit, said parameters being associated with different container types and/or container cross sections of print areas to be printed on.

The container reception means may have a container reception area with a reception device in which the respective accommodated container can be fixed in position. The container reception area may be configured e.g. as a device on a rotary plate for accommodating the container bottom and/or as a centering device for accommodating an upper part of the container, in particular a container opening of bottles or bottle-like containers. The containers can thus be accommodated in the container reception means in a particularly stable manner and the printing accuracy can be increased. The centering device may comprise a centering bell. The reception area may be arranged eccentrically to the container reception means in that a center axis of the reception area, i.e. a perpendicular axis through the center of area of the container base to be accommodated in the reception area, referred to as center axis of the container hereinbelow, is arranged such that it is displaced relative to a center axis of the container reception means, i.e. a perpendicular axis through the center of area of the container reception means.

In order to allow, in the manner described above, an adjustment of the distance between the axis of rotation and the center axis of the reception area when a change of products takes place, the container reception means may each be provided with a guide unit of a reception device that is displaceable relative to the container reception means, said guide unit extending radially to the respective axis of rotation. As described above, the guide unit can be realized e.g. as a linear shaft with an electronically controllable servomotor. It is thus possible to adjust e.g. the eccentricity of the container reception area for various types of containers.

The reception device and/or the centering device may be replaceable. Likewise, the container reception means as a whole may be replaceable. The container reception means can thus be adjusted to specific types of containers in a particularly easy manner. The container reception means, reception devices and/or centering devices may comprise single-hand fasteners for quick-changing operations, which are optionally configured as a spring clip or as a bayonet lock.

By means of the at least one variably controllable first drive, the container reception means can be rotated individually and independently of one another about their respective axes of rotation with an angular speed profile predetermined by the open-loop and/or closed-loop control unit. In particular, a container reception means accommodating a container can be rotated about its axis of rotation such that a print area on the outer surface of the accommodated container is positioned in front of a print head, past which the container reception means is moved. To this end, the container reception means and/or the first drive may be provided with a rotary encoder, which may be configured as an incremental encoder and/or as an absolute encoder and which allows an adjustment of an angular position of the container reception area with respect to the axis of rotation, said angular position being predetermined by the open-loop and/or closed-loop control unit. In the case of containers having a non-circular base, the reception device may be arranged with respect to the container reception means such that the containers are accommodated with a desired orientation with respect to the axis of rotation. In the case of containers having a circular base, the reception device and/or the centering device may additionally be provided with a rotating device capable of rotating the accommodated containers about their axes of rotation such that the respective print area on the outer container surface to be printed on assumes a predetermined angular position with respect to the axis of rotation of the respective container reception means. Such an additional rotating device may e.g. be coupled with an opto-electrical control system for orienting, prior to starting the printing process, labelled containers such that the label to be printed on is oriented towards the print head. The adjustment of the predetermined angular position and/or the additional rotation of the container about its axis of rotation may be executed by means of the open-loop and/or closed-loop control unit as an initial orientation prior to starting the respective printing process.

The at least one first drive may be configured to rotate one or a plurality of container reception means about their respective axes of rotation. Hence, the device may comprise either a shared first drive for rotating the container reception means about their respective axes of rotation or individual first drives for rotating a respective single container reception means about its axis of rotation. In the first case, one drive, which rotates the container reception means carrying the container, that is to be treated by the printing unit or print head at the moment in question, about its axis of rotation, may be provided per printing unit or print head. To this end, the respective drive may be arranged in a stationary manner in the area of the respective printing unit or print head. In the second case, each container reception means may be provided with a separate first drive, which is in particular adapted to be moved together with the container reception means along the closed path. In this case, each container reception means can be rotated individually and independently of the other container reception means by means of the open-loop and/or closed-loop control unit. Depending on the number of printing units or print heads used, either the first or the second variant may be of advantage.

The at least one first drive may be configured as an electric motor. The respective first drive may be connected via shafts to one or to a plurality of container reception means. In addition, a gear unit may be arranged between the respective drive and one or a plurality of container reception means. The electric motors may be configured as stepping motors or as servomotors. When configured as servomotors, the electric motors may comprise one of the above mentioned rotary encoders and/or Hall sensors. Alternatively, the at least one first drive may also be configured as a control curve, whereby a particularly cost-efficient drive for rotating the container reception means is obtained. When a change of products takes place, the control curve can be replaced by the control curve corresponding to the new container to be treated.

Due to the fact that the at least one drive for rotating the container reception means is adapted to be variably controlled by means of at least one open-loop and/or closed-loop control unit, the container reception means may, in principle, be rotated relative to the respective axis of rotation with an arbitrary angular speed or an arbitrary angular speed profile. The angular speed is only limited by the constructional restrictions imposed by the drive used. Likewise, constructional data of the container reception means or printing units used may lead to a limitation of the adjustable rotary angles to a predetermined range. When the printing process has been finished, the respective container reception means can be rotated back to a predetermined starting position by means of the open-loop and/or closed-loop control unit or it may assume a predetermined angular position for further treatment.

Other than in the case of gears that are in rolling contact, the variable control of the respective first drive allows to adapt the rotary movement of the container reception means to the respective circumference of the container and in particular to the shape of the cross-section of the print area, which is to be printed on, parallel to the base of the container, which cross-section will be referred to as horizontal cross-section in the following. Hence, the rotary movement of the container reception means can be open-loop controlled or close-loop controlled such that the surface elements of the print area will be moved past the respective print head with a predetermined speed (see below) during the printing process. It is, for example, possible to open-loop control or close-loop control the drive such that the surface element of the print area printed on by the print head at the moment in question reaches the predetermined speed. In addition, it is possible to predetermine a specific speed profile that correlates with different surface elements of the print area.

In particular, an open-loop controlled or closed-loop controlled superimposition of the respective rotary movement and of the movement of the respective container reception means along the closed path allows a printing distance to be realized that is substantially constant during the whole printing process. As has already been mentioned hereinbefore, the printing distance is defined as the distance between the print head in question and the respective surface element of the print area to be printed on, along the discharge direction of the print color or printing ink. The printing nozzles arranged along the longitudinal axis of the print head define together with the discharge direction of the print color or printing ink a printing plane of the print head, in which the printing distance can be defined as the perpendicular distance, seen with respect to the longitudinal axis, between the surface element to be printed on and the print head. A closed loop control of the first drive can take place e.g. in accordance with an angular position and/or an angular speed of the container reception means determined by a rotary encoder.

Deviating distances of the printing nozzles from the above defined printing plane may lead to minor printing speed deviations and/or drop displacements, since high-resolution print heads normally have a plurality of nozzle rows. It is, however, possible to adequately calculate and easily correct these deviations and/or displacements via time delays or print image corrections. Generally, the invention is so conceived that print image distortions, caused by different geometrical conditions (printing distances, curvatures of the surface, etc.), are determined mathematically or empirically and corrected. This correction can be executed either by electronically controlling the print head through e.g. delays or by correcting the print image.

The open-loop and/or closed-loop control of the first drive is performed in accordance with the shape of the horizontal cross-section of the print area, the relative position of the respective axis of rotation and of the center axis of the container to be printed on as well as the shape of the container. When the print area is convex with respect to the outer surface of the container and has a non-constant radius of curvature, an increase in the printing distance caused by the movement of the print area past the print head can be compensated for by rotating the container towards increasing radii of curvature. The optimum relative position of the axis of rotation with respect to the respective container reception means and the optimum relative position of the reception area with respect to the container reception means can be determined in advance in accordance with the desired printing distance, the shape of the container and of the print area and a possibly existing tiltability of the print head, and can be stored in a memory unit of the open-loop and/or closed-loop control unit.

A substantially constant printing distance may be understood as a printing distance that is constant within predetermined tolerance limits. The tolerance limits can be specified e.g. relative to a mean printing distance, e.g. as 10% of the mean printing distance, or relative to a resolution of the print image to be produced, e.g. as five times the distance between neighboring printed dots. Mean distances lie in a range of 1 mm to 10 mm, preferably, however, between 2 mm and 6 mm. The mean distance is influenced by the print quality and the printing technology. Alternatively, a substantially constant printing distance may also be understood as a printing distance that is larger than or equal to a predetermined minimum printing distance and smaller than or equal to a predetermined maximum printing distance. A minimum printing distance may e.g. be indicated as an absolute value, e.g. 2 mm, or as a relative value related to a print resolution, e.g. as ten times the distance between neighboring printed dots. Likewise, a maximum printing distance may be indicated as an absolute value, e.g. 3 mm, or as a relative value related to a print resolution, e.g. as fifteen times the distance between neighboring printed dots. The printing distance may be predetermined depending on the material of the surface to be printed on, the print color or printing ink used and the characteristics of the print head used. Since the printing distance can be maintained substantially constant by superimposing the open-loop controlled or closed-loop controlled rotary movement and the movement along the closed path, the quality of the print image produced will be increased, in particular in the area of the edges of the respective print area. Large printing distances normally lead to a deterioration in the print quality. The above described measures allow printing also on difficult surface areas due to the reduced printing distance.

The open-loop and/or closed-loop control unit may comprise a microprocessor or a similar process unit and a memory unit. The memory unit may have stored therein parameters and/or curves for controlling the at least one first drive after the fashion of a type management, said parameters and/or curves being associated with different types of containers and/or horizontal cross-sections of the print areas. The data stored may in particular be parameterizations of the horizontal cross-sections in the form of two-dimensional polar coordinates with respect to a center axis of the respective container and/or the respective axis of rotation of the container reception means. Such parameterizations can then be used for calculating therefrom with the aid of the microprocessor the angular positions and/or angular speeds required for accomplishing a substantially constant printing distance. Alternatively, the necessary angular positions and/or angular speeds may also be stored directly in the memory unit. Storing the parameters and/or curves allows a particularly fast change between various types of containers.

According to a further development, the device may comprise at least one second drive used for moving the container reception means along the closed path and configured such that the container reception means is moved past the print head with a predetermined speed. The nature of said at least one second drive depends essentially on the structural design of the conveying system. If the conveying system is e.g. configured in the form of a carousel, the conveying system may be driven like a rotor. In particular, a single electric motor, which is adapted to be variably controlled by means of the open-loop and/or closed-loop control unit, can move the plurality of container reception means arranged on the carousel as a second drive along the circular path of the carousel. As has been described above, conveyor belts, conveyor chains and/or linear motors may be used for the at least one second drive driving the container reception means along a conveying system defining a closed loop. Linear motors allow, in an advantageous manner, the container reception means to be driven individually with a flexibly controllable speed along the conveying path of the conveying system.

The at least one second drive is adapted to be variably controlled by means of the open-loop and/or closed-loop control unit such that a container reception means carrying a container to be printed on is moved past a specific print head with a predetermined speed. When a shared second drive is used, e.g. in combination with a carousel, possible additional printing units and/or print heads can be arranged along the periphery of the carousel such that a plurality of printing processes, e.g. with different print colors or printing inks, can be carried out synchronously on different containers. When individual second drives are used, e.g. in the form of a linear motor, such synchronization will not be necessary.

The speed with which the container reception means is moved past the print head, i.e. the speed of the container reception means along the closed path, can be predetermined by the open-loop and/or closed-loop control unit depending on a printing performance of the print head, a resolution of the print image to be produced and/or a shape of the container and/or of the horizontal cross-section of the print area. In particular, the predetermined speed can be flexibly adapted to the respective type of container in accordance with a type management of the device stored in a memory unit of the open-loop and/or closed-loop control unit.

According to a further development, the at least one second drive can be closed-loop controlled or open-loop controlled such that the predetermined speed of the container reception means is constant at least during printing on the print area, the first drive being open-loop controlled and/or closed-loop controlled, by means of the open-loop and/or closed-loop control unit, with respect to an angular speed of the rotation of the container reception means about its axis of rotation and as a function of the predetermined constant speed of the container reception means such that a speed component of a surface element of the print area to be printed on, the component being perpendicular to a printing plane of the print head, is substantially constant during printing on the print area.

In particular, the first drive can be open-loop controlled and/or closed-loop controlled such that the speed component perpendicular to the printing plane is constant within predetermined tolerance limits, e.g. 5% of the mean speed component during the printing process. Typical mean speed components lie within the range of 1 m/min to 100 m/min, preferably between 20 m/min and 75 m/min. Speed tolerances lie within the range of +/−10% preferably within the range of <+/−5%. Unavoidable tolerances can be corrected through print image corrections or electronic control of the print head, e.g. via delays.

A constant speed of the container reception means here and in the following a constant speed, which, during the printing period, is different from zero along the closed path. According to this further development, the constant speed of the container reception means then has superimposed thereon a rotary movement, which is open-loop controlled and/or closed-loop controlled by means of the open-loop and/or closed-loop control unit, about the axis of rotation of the container reception means such that a speed component of a surface element of the print area to be printed on, which is perpendicular to a printing plane of the print head, is substantially constant during printing on the print area. In other words, the first drive is open-loop controlled and/or closed-loop controlled such that the whole print area is moved through the printing plane with a substantially constant overall speed perpendicular to the printing plane, the movement of the print area and its overall speed resulting from the superimposition of the movement of the container reception means along the closed path and the rotary movement of the container reception means.

Generally, the print head and the conveying system are arranged relative to one another such that the closed path of the container reception means passes perpendicularly through the printing plane of the print head. When the print heads are tiltable and in particular for realizing printing that takes place as perpendicularly as possible to the container surface, deviations from this mode of arrangement are possible, at least temporarily. The printing plane is defined by a parallel to the respective axis of rotation of the container reception means through the print head in question and by the discharge direction of the print color or printing ink from the print head in question. When the print heads comprise a plurality of printing nozzles arranged along a longitudinal axis of the respective print head, this definition corresponds to the above definition using the longitudinal axis. In order to produce a print image that is as uniform as possible, especially as regards the resolution of the print image, a printing speed that is as constant as possible perpendicular to the printing plane during the printing process should be aimed at. The present further development allows this kind of printing speed by open-loop controlled and/or closed-loop controlled adaptation of the angular speed of the rotary movement about the respective axis of rotation by means of the open-loop and/or closed-loop control unit. When a carousel is used as a conveying system, a constant speed of the container reception means can be realized in a particularly easy manner by means of a shared second drive.

The present invention is, however, not limited to constant speeds of the container reception means, but it explicitly comprises further developments in the case of which the predetermined speed of the container reception means during printing on the print area follows a speed profile, in particular a non-constant speed profile, predetermined in accordance with a shape of the print area, and in the case of which the first drive is open-loop controlled and/or closed-loop controlled by means of the open-loop and/or closed-loop control unit with respect to an angular speed of the rotation of the container reception means about its axis of rotation and as a function of the predetermined speed profile of the container reception means, such that a speed component of a surface element of the print area to be printed on, the component being perpendicular to the printing plane of the print head, is substantially constant during printing on the print area.

It follows that, according to this further development, the first drive is open-loop controlled and/or closed-loop controlled as a function of the predetermined speed profile such that all the surface elements of the print area to be printed on have, at the respective moment in time at which such printing takes place, approximately the same speed component perpendicular to the printing plane of the print head. For print areas which are convex with respect to the outer surface of the container and the horizontal cross-sections of which have a non-constant radius of curvature with a single minimum, i.e. whose horizontal cross-sections can, in their parameterization in the form of two-dimensional polar coordinates, only have a polar angle with a minimum radius with respect to a center axis of the container or the respective axis of rotation of the container reception means, it is possible to determine for any desired speed of the surface element to be printed on, perpendicular to the printing plane at least one speed profile of the container reception means and one angular speed profile of the rotation of the container reception means, which guarantee, during the entire process of printing on the print area, the substantially constant printing distance as well as the substantially constant perpendicular speed component of the surface element to be printed on. The respective speed profiles and angular speed profiles can either be calculated automatically by a microprocessor of the open-loop and/or closed-loop control unit on the basis of the shape of the horizontal cross-section of the print area, the container shape and/or the relative position of the axis of rotation to the center axis of the container or stored in the form of a type management for a fast change of products in a memory of the open-loop and/or closed-loop control unit.

The above described convex print areas comprise in particular print areas on the broad sides of oval or elongate oval containers. A device according to this further development can therefore be used for printing on oval or elongate oval containers with a constant printing distance and also with a constant surface speed perpendicular to the printing plane. This leads to a significantly improved quality of the print image in combination with a high throughput of containers to be printed on.

According to a further development, the conveying system may be configured such that the closed path is straight at least in the region of the print head. The region of the print head can here be defined as a part of the closed path, which comprises at least the part provided for the printing process. According to this further development, this part of the closed path is straight, whereby the first and/or second drive can be open-loop controlled and/or closed-loop controlled in a particularly easy manner during printing on the print area, since it is not necessary to take into account a change in the printing distance resulting from a curvature of the path in the region of the print head. Such a straight section of the closed path can e.g. be realized with an endlessly circulating driven conveying system defining a closed loop. Also in this case, the second drive can be realized in an advantageous manner by means of a linear motor at least in the region of the print head, whereby an individual movement of the container reception means in the region of the print head is made possible.

According to an alternative further development, the conveying system may be configured such that the closed path in the region of the print head is curved such that a perpendicular distance between the axis of rotation of the container reception means and the print head follows a profile, predetermined in accordance with a shape of the print area, in the region of the print head.

According to this further development it is assumed that the relative distances of the axis of rotation from the center axis of the container reception means and from the center axis of the accommodated container and the reception area, respectively, are constant during the printing process. The axis of rotation thus follows a path similar to that of the center axis of the container reception means, even in the case of an eccentric position of the axis of rotation, insofar as also the axis of rotation follows a curved, closed path. In the simplest case, i.e. when the axis of rotation is positioned centrically, the two paths correspond to each other.

The perpendicular distance between the axis of rotation and the print head can now be defined as the perpendicular distance between the straight line defined by the axis of rotation and a point on the print head, in particular a discharge opening of a printing nozzle of the print head. The print head may here be stationary or, as described hereinbefore, tiltable relative to the printing unit. The predetermined profile may be described e.g. with respect to a length coordinate of the path from a reference point onwards or with respect to an angle between the plane defined by the axis of rotation and a parallel to the axis of rotation through the print head and the printing plane of the print head. It should here be emphasized that the further development described explicitly comprises curved paths which do not correspond to the circumference of a circle, as is the case when the conveying system is configured as a carousel, but which follow a more complex curvature profile, which is specially suitable for printing on a specific class of horizontal cross-sections of print areas. For example, a special curvature may be provided for print areas that are convex with respect to the outer surface of the container and another special curvature may be provided for print areas that are concave with respect to the outer surface of the container. In particular, by positioning curved path elements for two or more classes, each with at least on printing unit, such that they follow one another along the closed path, also sectionwise printing on complex print areas, e.g. partially flat, partially curved print areas, is made possible, and the above described conditions of a constant printing distance and a constant perpendicular surface speed can always be guaranteed.

A good approach to the determination of the curvature of the closed path to be predetermined in the region of the print head is given by the parameterization of the horizontal cross-section of the print area in the form of two-dimensional polar coordinates with respect to the axis of rotation, the perpendicular distance following the profile of the radius as a function of the polar angle. The curvature to be predetermined can be realized e.g. by means of replaceable curve profiles for defining the path curvature or by mounting the container reception means including the respective first drive onto special conveying elements, which, driven by the at least one second drive, follow a simple linear or circular path. The container reception means and their axes of rotation may here be configured such that they are displaceable relative to the respective conveying elements by means of linear shafts and servomotors.

By predetermining a specially curved path in the region of the print head, also more complex print areas than the above-mentioned oval or elongate oval print areas can be printed on with a constant printing distance and a constant perpendicular surface speed. For example, also print areas that are concave with respect to the outer surface of the container, partially flat, partially curved print areas and partially concave, partially convex print areas, such as wave-shaped print areas, can be printed on with a constant printing distance and a constant perpendicular surface speed.

According to a further development, the profile of the perpendicular distance may be predetermined such that an angle of intersection of the print area with the printing plane of the print head is substantially constant during printing on the print area. The angle of intersection is here the angle between the tangent on the horizontal cross-section of the print area at the point of intersection with the printing plane. A substantially constant angle of intersection may in particular be an angle of intersection that is constant within predetermined tolerance limits, e.g. +/−5 degrees, preferably +/−2 degrees. A constant angle of intersection guarantees especially a constant angle of impingement of the jet of printing ink or print color ejected from the print head and impinging on the surface element to be printed on, and thus a uniform resolution of the print image.

As described hereinbefore, the special curvature of the path in the area of the print head may be calculated automatically on the basis of a parameterization of the horizontal cross-section of the print area by means of a microprocessor of the open-loop and/or closed-loop control unit or it may be stored in a memory unit of the open-loop and/or closed-loop control unit in the form of a type management. In particular, the curvature of the path and the associated control curves and/or control parameters for the first and second drives may be stored in the memory unit for specific types of containers, whereby a particularly fast change of products can be accomplished.

According to another further development, the closed path may be curved in the region of the print head such that the angle of intersection is substantially 90°. In this case the print color or printing ink discharged from the print head will impinge substantially perpendicularly on the surface element of the print area to be printed on, i.e. the printing plane intersects the print area at right angles. The speed component of the surface element to be printed on, which is perpendicular to the printing plane, therefore corresponds to the overall surface speed of the surface element, i.e. tangentially to the surface. It follows that, when the first and second drives are open-loop controlled or closed-loop controlled according to the above described further developments, a constant surface speed of the whole print area during the printing process and thus an excellent print quality of the print image produced will be accomplished.

As has already been mentioned, the container reception means may be configured such that the container to be received can be accommodated in the container reception means eccentrically to the axis of rotation. As described above, this may be realized e.g. by eccentrically arranging the reception device with respect to the center axis of the container reception means. Likewise, the reception device may be arranged such that it is displaceable relative to the container reception means, as has been described hereinbefore. In this case, a possibly provided centering device may be configured such that it is displaceable as well. In addition, the centering device may be of the self-centering type insofar as it rotates back to a predetermined angular position relative to the respective axis of rotation when the container reception means is empty. This can be accomplished e.g. by means of a control curve and/or a spring mechanism of the centering device.

By eccentrically arranging the reception device, also print areas whose horizontal cross-sections include segments of a circle can be printed on with a constant printing distance and a constant perpendicular surface speed making use of the devices according to the above described further developments. Print areas on containers of an arbitrarily complex surface shape can thus be printed on with high print quality and with a high throughput by combining specially curved path segments in the region of the print head, eccentrically arranging the reception device and controlling first and second drives by open-loop control and/or closed-loop control.

The above described tasks are also solved by a method of printing on containers, in particular non-rotationally symmetric containers, which are conveyed by means of a plurality of container reception means of a conveying system defining a closed path, said container reception means being arranged for rotation about axes of rotation, and said method comprising the following steps:

moving at least one container reception means along the closed path such that the container reception means is moved past a print head of a printing unit with a predetermined speed, and simultaneously rotating the container reception means about its axis of rotation such that a print area of an outer surface of a container accommodated in the container reception means is moved past the print head at a predetermined, substantially constant printing distance.

The same variations and further developments, which were described hereinbefore in connection with the device for printing on containers according to the present invention, can here also be applied to the method for printing on containers. Likewise, the above described definitions also apply to said method.

In particular, the movement of the at least one container reception means along the closed path may, as described above, be executed automatically by means of at least one second drive, said at least one second drive being variably controllable by means of an open-loop and/or closed-loop control unit. The step of moving the at least one container reception means along the closed path may comprise an open-loop and/or closed-loop control of the at least one second drive in such a way that the container reception means is moved past the print head with the predetermined speed.

Likewise, the simultaneous rotation of the container reception means about its axis of rotation may, as described above, be executed automatically by means of at least one first drive, said at least one first drive being variably controllable by means of the open-loop and/or closed-loop control unit. The step of simultaneously rotating the container reception means about its axis of rotation may comprise an open-loop and/or closed-loop control of the at least one first drive in such a way that the print area is moved past the print head at the predetermined substantially constant printing distance.

In addition, the method may comprise printing on the print area by means of the print head of the printing unit with at least one print color or printing ink.

Furthermore, the method may comprise the step of automatically calculating the control curves and/or control parameters for open-loop controlling and/or closed-loop controlling the first and/or second drive(s) by means of a microprocessor of the open-loop and/or closed-loop control unit in accordance with a container type and/or the horizontal cross-section of the print area. In this respect, the control curves and/or control parameters may especially be calculated as a function of parameterizations of the horizontal cross-sections in the form of two-dimensional polar coordinates with respect to a center axis of the respective container and/or the respective axis of rotation of the container reception means, which can be stored in a memory unit of the open-loop and/or closed-loop control unit in the form of a type management.

Alternatively, the necessary control curves and/or control parameters may also be stored directly in the memory unit. In this case, the method may comprise reading the control curves and/or control parameters, which are associated with the container type to be printed on and/or the horizontal cross-section of the print area, from the memory unit of the open-loop and/or closed-loop control unit.

Storing the required parameters and/or curves in a type management allows a particularly fast change between different types of containers. The respective speed profiles of the container reception means along the closed path and angular speed profiles of the rotation of the container reception means can thus either be calculated automatically by the microprocessor of the open-loop and/or closed-loop control unit on the basis of the shape of the horizontal cross-section of the print area, the shape of the container and/or the relative position of the axis of rotation to the center axis of the container, or they may be stored in the memory unit of the open-loop and/or closed-loop control unit in the form of a type management for a rapid change of products.

In accordance with the method according to the present invention, the containers accommodated in the container reception means are, for the purpose of printing on the print area, moved past the respective print head by means of an open-loop controlled and/or closed-loop controlled movement of the respective container reception means along the closed path and a simultaneous, i.e. superimposed, rotary movement of the container reception means about its axis of rotation.

According to a further development, the method may additionally comprise a simultaneous adaptation of a perpendicular distance between the axis of rotation of the container reception means and the print head in the region of the print head in accordance with a profile predetermined depending on a shape of the print area, in such a way that an angle of intersection of the print area with a printing plane of the print head is substantially constant. The variations and further developments described hereinbefore in connection with the device for printing on containers may be applied also in this case. Likewise, the above described definitions also apply to the method according to the present further development.

The simultaneous adaptation of the perpendicular distance between the axis of rotation of the container reception means and the print head may, as described above, be executed automatically by an open-loop controlled and/or closed-loop controlled movement of the container reception means along a respective path curved in the region of the print head or by an open-loop controlled and/or closed-loop controlled displacement of the container reception means including its axis of rotation, i.e. including respective bearing elements and/or an individual first drive carried along with the container reception means, along a linear shaft. To this end, the container reception means may be mounted on special conveying elements, which, driven by the at least one second drive, follow a simple linear or circular path. As described above, the container reception means may be displaced e.g. by means of linear shafts and servomotors. It should be emphasized that, due to the variable control of the first and second drives, a respective path section having a specific curvature can be used for a whole class of shapes of horizontal cross-sections and/or types of containers, unless a constant angle of intersection of the print area with the printing plane of the print head is required. For constant angles of intersection the required curvature of the path section in the region of the print head can easily be adapted to the respective type of container and the horizontal cross-section of the print area by means of replaceable curve profiles for defining the path curvature.

A particularly fast adaptation of the curvature of the respective path section can be accomplished by means of the above described displaceability of the container reception means. In this case the simultaneous adaptation of the perpendicular distance of the axis of rotation may comprise reading from a memory unit of the open-loop and/or closed-loop control unit the control curves and/or control parameters for controlling the servomotor which drives the linear shaft.

It follows that, by open-loop controlled and/or closed-loop controlled superimposition of a rotary movement of the container reception means about its axis of rotation on the movement of the container reception means along the closed path, a printing distance that is constant during the entire printing process as well as a constant surface speed perpendicular to the printing plane can be guaranteed even for complex-shaped containers to be printed on. Both the print quality of the print image produced and the throughput of containers can be improved in this way. By predetermining a special curvature of the path section in the region of the print head, it is additionally possible to realize a constant angle of intersection between the surface to be printed on and the printing plane, i.e. in particular a perpendicular angle of printing, whereby the quality of the print image is improved still further. On the basis of its most flexible embodiment, the device according to the present invention is able to print on any kind of container shape with high quality and high speed as long as the horizontal cross-section of the print area can be parameterized in a continuously differentiable manner. For surfaces with corners, edges or kinks, the print image can in most cases be divided into a plurality of print areas, which each allow a continuously differentiable parameterization. In these cases, the surface can therefore be printed on sectionwise.

Quite generally, it should be mentioned that such devices, in particular printing machines, allow direct and/or indirect printing of different print images on a plurality of containers within one production cycle. This means that a first number of first print images can be applied to a first number of containers and a second number of print images can be applied to a second number of containers in a subsequent step carried out immediately afterwards. This can be done without any long and complicated changeover times and operations being necessary, but a smooth transition takes place on the machine side (hardware). Minor changes would only be necessary as regards the software, but these changes do not require much effort. Thus, the end user is not, as known as a drawback from the prior art, bound to a specific number of residual labels that may perhaps have to be stored temporarily. There is virtually no specific volume of print images that has to be purchased, as is the case with conventional labels.

Additional features and exemplary embodiments as well as advantages of the present invention will be explained in more detail in the following making reference to the drawings. It goes without saying that the embodiments do not exhaust the field of the present invention. It also goes without saying that some or all of the features described hereinbelow may also be combined with one another in a different way.

BRIEF DESCRIPTION OF THE SEVERAL VIEWS OF THE DRAWINGS

FIG. 1 shows a container treatment device for printing on containers 110 in a top view. The exemplary embodiment shown here, which comprises a carousel 100 as a conveying system, is frequently used in container treatment devices of the beverage industry and also in the field of cosmetic and sanitary products. A single-track stream of containers 140 is divided in a predetermined manner by a separating screw (not shown) and then supplied to an infeed star wheel 150, which takes up the containers 110 individually and advances them to the container reception means of the carousel 100. Prior to being transferred to the infeed star wheel 150, the containers can be pretreated through an input of energy, e.g. by means of plasma or flame, for effectively modifying the free surface energy. In addition, the static charge of the containers can be eliminated by ionizing the air.

To make things easier, the containers are shown with a circular cross-section, e.g. as bottles or bottle-like containers, in this exemplary representation. However, it goes without saying that the shape of the container reception means can easily be adapted to non-rotationally symmetric containers. In particular, container reception means may be employed, which can be used generally for containers having a great variety of shapes and circumferences by arranging at or on the container reception means replaceable or adaptable reception devices for containers with specific base shapes. The container reception means 130 are arranged on the carousel such that they are displaced relative to one another at regular angular distances about the axis of rotation 160 of the rotor of the carousel 100. Each individual container reception means is adapted to be rotated about its own axis of rotation (cf. FIG. 2).

Figure 1:
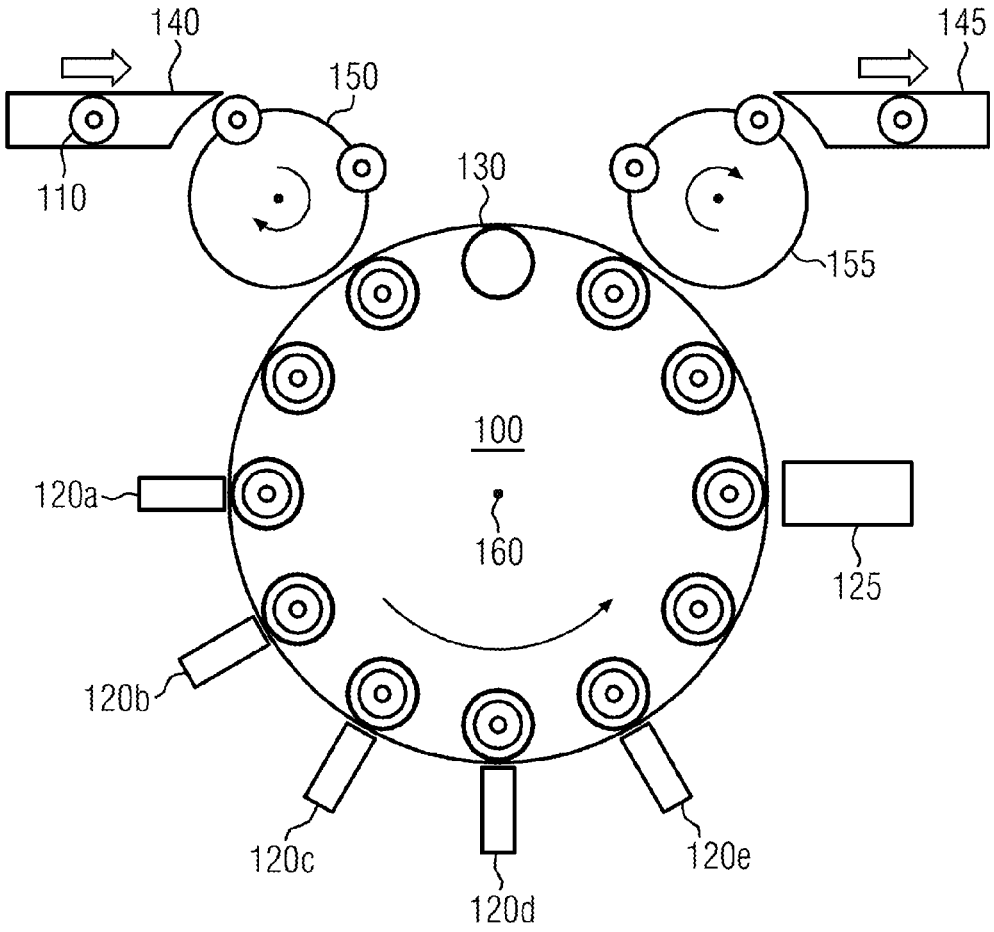
FIG. 1 shows an exemplary embodiment of a device for printing on containers including a carousel as a conveying system.

By rotating the carousel 100 about the axis of rotation 160, the container reception means 130 are moved past a plurality of printing units 120*a-e* arranged on the periphery of the carousel. By means of one or a plurality of print heads of each printing unit, a print area on the respective outer surface of the container is printed on while the containers carried by the container reception means are moved past the printing unit. In so doing, the printing units 120*a-e* can print different colors, e.g. yellow, magenta, cyan and black, on the same print area or print the respective color or colors on different print areas. In addition, the last printing unit 120*e* may apply a sealing or cover layer so as to protect the print image against external influences. Furthermore, the periphery of the carousel has arranged thereon a curing station 125 for fixing the print image. Depending on the respective print color or printing ink, said fixing may be executed by means of infrared radiation, UV radiation, electron beams, microwaves and the like. The printing units 120*a-e* as well as the curing station 125 are formed on the periphery of the carousel in a stationary manner in this representation. In addition, other colors and decoration technologies may be used on the carousel.

Through open-loop controlled and/or closed-loop controlled rotation of the carousel with a predetermined angular speed or a predetermined angular speed profile by means of a second drive in the form of a stepping motor or a servomotor, which is here not shown, the container reception means can be moved past the respective printing units with a predetermined speed. After the curing process, the containers are transferred one by one to a discharge star wheel 155, which, in turn, transfers them to a discharge stream 145.

The present invention is, however, not limited to carousel-like conveying systems, but is also applicable to general conveying systems as long as the latter are provided with the container reception means described and with at least one open-loop controllable or closed-loop controllable second drive. Instead of the rotor 100, a conveying system may in particular be used, in which a plurality of container reception means are driven by at least one second drive along a path defining a closed loop and thus circulate endlessly. The conveying system may, by way of example, be configured with a linear motor and individually movable conveying elements, which carry along the container reception means and, optionally, the respective first drive thereof for rotating the container reception means in question. The printing units may here be arranged especially along a straight path section of the conveying system.

Irrespectively of whether the shape of the path in the area of the respective printing unit is a segment of a circle, as in the case of the carousel shown, or a straight line, the distance between the print head and the surface element to be printed on normally changes during printing on curved print areas due to the fact that the container reception means continues to move along the path during the printing process.

This problem, which often arises in the prior art, will be explained in more detail making reference to the schematic representation of FIG. 3. The figure shows as an example the strong variation of the printing distance during printing on the broad side of an oval container according to a prior art method. To make things easier, the path section, on which the container reception means (not shown) carrying the oval container 300 is moved past the print head 320, is shown as a straight line 380. It is easily evident that, also when a carousel is used as a conveying system, strong variations of the printing distance will normally occur.

Figure 3:
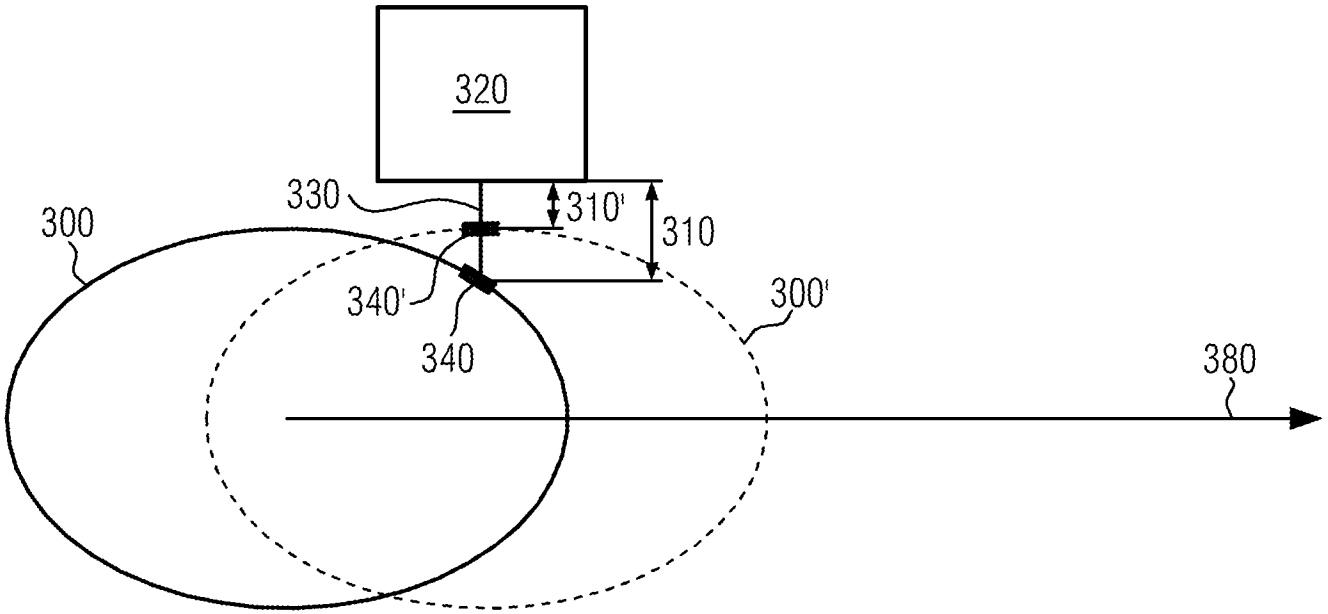
FIG. 3 shows schematically the strong variations of the printing distance during printing on an oval container according to a prior art method.

In the prior art, the container is moved past the print head 320 without being rotated, as shown in FIG. 3. The figure shows two snap-shots 300 and 300' of the container, between which the container continues to move with a predetermined speed in the direction of the linear path 380. Due to the movement of the container reception means along the path, the inkjet 330 ejected from the print head 320 sweeps over different surface segments 340 and 340' at the two moments in time shown. Due to the curvature of the print area to be printed on, the printing distance changes substantially from 310 to 310' during this period. However, a strongly varying printing distance leads to a deterioration of the print image, as has been described hereinbefore.

Figure 4:
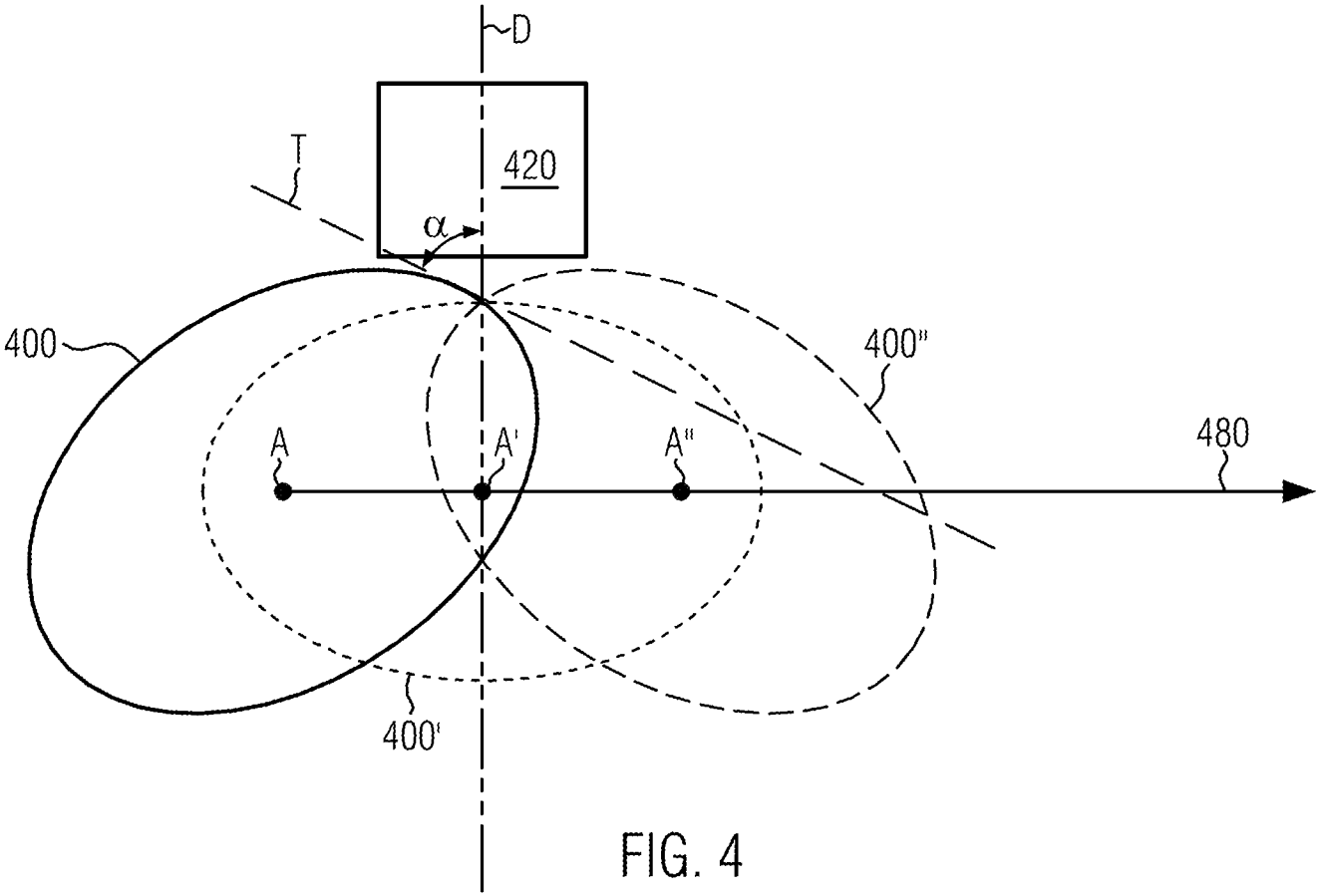
FIG. 4 shows, in a schematic representation, how the rotation of the oval container to be printed on is superimposed on the linear movement of the container reception means in accordance with the present invention.

The present invention solves the problem of variations in the printing distance by superimposing a controlled rotary movement of the container reception means about its axis of rotation on the movement of the container reception means along the path section, as schematically shown in FIG. 4.

Also in FIG. 4, the container 400 continues to move along the linear path 480 in three snap-shots 400, 400' and 400", as can be seen from the change in position of the axis of rotation A, A' and A". The container is, however, simultaneously rotated clockwise by rotating the container reception means about its axis of rotation A, A' and A". When, for example, the printing distance between the surface element to be printed on and the print head 420 increases between the snap-shots 400' and 400", this increase is counteracted by the decrease in the printing distance caused by the rotation of the oval container towards larger radii of curvature. In the case shown here, the center axis of the oval cross-section and the axis of rotation of the container reception means coincide. The effect can, however, also be achieved or even be intensified in the event that the axis of rotation is located eccentrically with respect to the cross-section of the print area, especially when the axis of rotation is arranged between the print head and the center axis of the container.

As indicated in the figure, the printing distance changes only insignificantly during the printing process due to the superimposition of the rotary and the linear movement of the container reception means. When suitable linear and angular speeds are chosen, the print area of an oval or elongate oval container to be printed on can even be moved past the print head at an exactly constant printing distance.

The figure additionally shows schematically the angle of intersection a between the tangent T on the surface element of the container 400 to be printed on and the exit direction D of the inkjet, which, together with the parallel to the axis of rotation A through the print head 420, defines the printing plane of the print head. Here it can be seen that, even in the case of a simple oval surface, the printing angle $\alpha$ may change substantially during the printing process.

Figure 2:
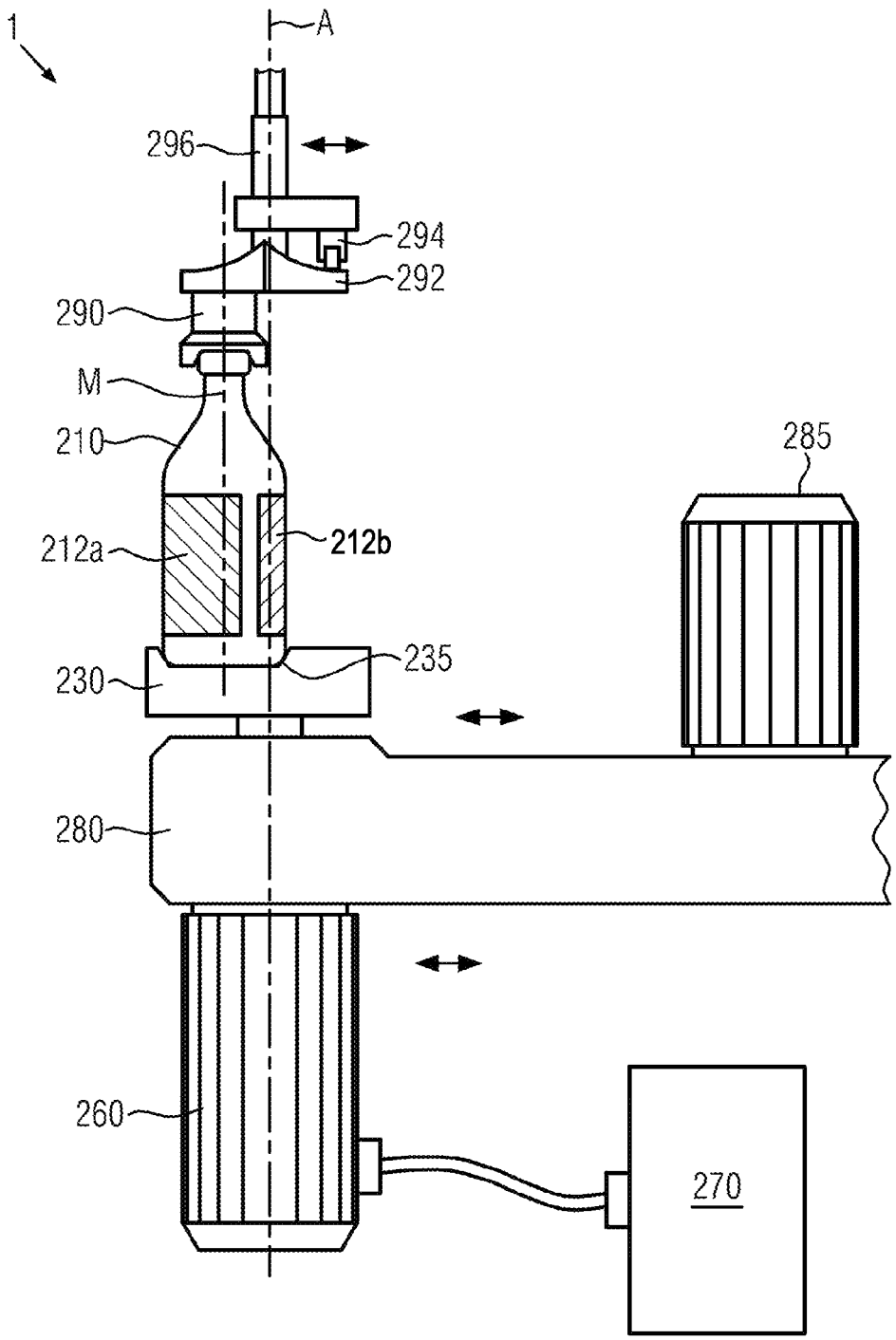
FIG. 2 shows, in a side view, an exemplary embodiment of a container reception means including an individual first drive and a linear shaft according to the present invention.

FIG. 2 shows, in a side view, an exemplary embodiment of a container reception means including the individual first drive and the linear shaft, with which the superimposition of the rotary and the linear movement of the container reception means shown in FIG. 4 can be realized. The container reception means shown comprises a rotary plate 230 and a centering device 290. The rotary plate 230 is driven via a shaft by a closed-loop controllable servomotor 260 as a first drive and a closed-loop control unit 270, said closed-loop control unit 270 being able to detect via a rotary encoder the precise angular position and/or angular speed of the drive 260 and to control the currents through the winding of the drive 260 such that the desired rotary position and/or the desired angular speed of the rotary plate 230 is/are accomplished. At the lower end of the container 210 the container bottom is accommodated in the reception area 235 of the rotary plate 230. The center axis M of the container is displaced relative to the axis of rotation A of the container reception means 230, the axis of rotation A extending within the reception area 235 for the container bottom in the case shown. The reception area 235 is here shown as a recess in the container reception means, so that when a change of products takes place, the container reception means has to be replaced. However, it goes without saying that the reception area 235 may also be provided with a reception device that is arranged on the rotary plate such that it can be separated therefrom. The reception device may be configured such that it is able to accommodate containers having different bases. In addition, the reception device may be configured such that it can be displaced relative to the container reception means, whereby the eccentricity of the axis of rotation relative to the center axis of the container can be adjusted.

For receiving a container opening that may possibly exist, as in the case of the bottle that is here exemplarily shown, the centering device 290 is provided, which is also supported such that it is rotatable about the axis of rotation A and which exhibits the same eccentricity as the rotary plate 230. The centering device 290 is here configured as a self-centering component by means of the control curve 292 and the roller 294. If the container reception means 230 is empty, the centering device 290 is rotated via the control curve 292 and a spring, which is here not shown, to a predetermined angular position such that a new container 110 can be taken up during the next movement past the infeed star wheel 150 and the centering bell of the centering device 290 is arranged in opposed relationship with the reception area 235. The shaft 296 of the centering device 290 is supported such that it is freely rotatable about the axis of rotation A via suitable bearings and does not have a drive of its own.

By means of the drive 260 and the closed-loop control unit 270, which additionally controls the second drive for the movement of the container reception means along the path section in the region of the print head, it is possible to control by open-loop or closed-loop control the rotary movement of the container reception means 230 about the axis of rotation A as a function of the predetermined speed profile with which the container reception means 230 is moved past the print head, such that the print areas 212*a* and 212*b*, respectively, of the container 210 are moved past the print head at a substantially constant printing distance and with a substantially constant surface speed perpendicular to the printing plane D. Due to the constant surface speed perpendicular to the printing plane D, each surface element of the print area 212*a* and 212*b*, respectively, is printed on by the inkjet print head 420 with the same resolution and precision. The constant printing distance additionally ensures a high quality of the print image. By means of a sensor (not shown), the printing distance can additionally be measured constantly and can be taken into account by the closed-loop control unit 270 for adapting the angular speed of the first drive 260 and/or the speed of the container reception means along the path by means of the second drive.

The exemplary embodiment of the container reception means in FIG. 2 additionally discloses a linear shaft 280 having secured thereto the container reception means 230 as well as the individual first drive 260. By means of an additional servomotor 285, which is open-loop controlled or closed-loop controlled by the normally stationary closed-loop control unit 270, the axis of rotation A and the center axis M of the container can be displaced in common with respect to the print head by operating the linear shaft 280. It is thus possible to realize e.g. a curved path of the axis of rotation A of the container reception means, this kind of curved path being shown in FIG. 6.

Figure 6:
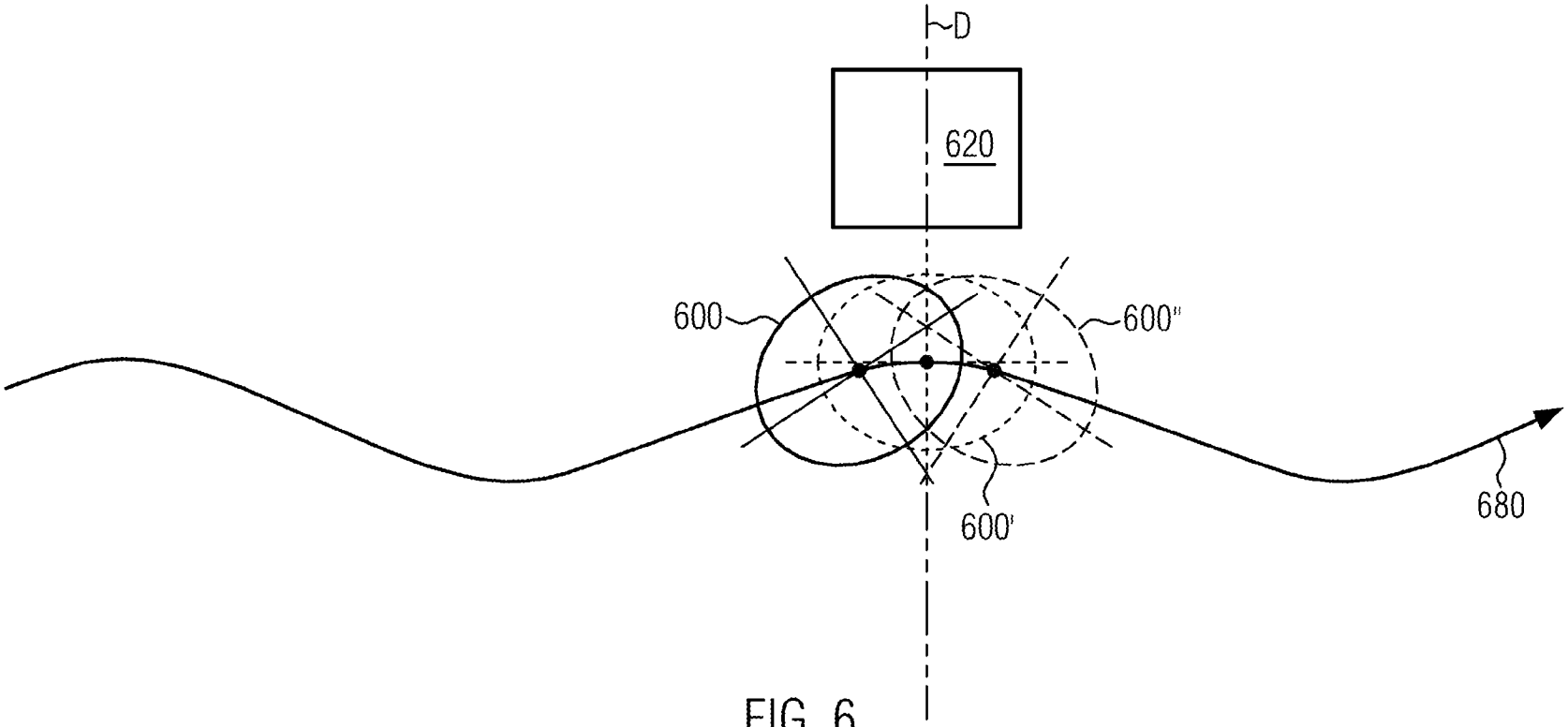
FIG. 6 shows, in a schematic representation, how the rotation of the oval container to be printed on is superimposed on the movement of the container reception means along a specially curved path in accordance with the present invention.

FIG. 6 shows a schematic representation of the superimposition of the rotation of the oval container to be printed on and of the movement of the container reception means along such a specially curved path. The axis of rotation of the container reception means, which is here shown as point of intersection of the respective cross, moves along a sinusoidal path 680. Due to the shape of the print area to be printed on, which is convex with respect to the outer surface of the container, the path is curved away from the print head 620 in the region of the latter, the minimum distance between the path and the print head being reached when the axis of rotation comes to lie in the printing plane D. Between the snap-shots 600, 600' and 600" the container is rotated clockwise about the axis of rotation such that a substantially constant printing distance and a substantially constant surface speed perpendicular to the printing plane D are obtained. The figure shown here only shows a schematic example for a curved path of the axis of rotation. When a more strongly curved path is chosen, a substantially constant angle of intersection between the surface to be printed on and the printing plane D can additionally be realized.

As mentioned above, a good approach to the determination of the curvature which is to be predetermined for the closed path in the region of the print head is given by the parameterization of the horizontal cross-section of the print area in the form of two-dimensional polar coordinates with respect to the axis of rotation, the perpendicular distance following the profile of the radius as a function of the polar angle. The polar angle is here equated with the angle between the printing plane D and the plane defined by the connecting line between the axis of rotation and the print head 620 and by the axis of rotation. The angle of rotation of the rotary movement about the axis of rotation can then be determined as a function of the position of the axis of rotation along the path such that the angle of intersection between the surface to be printed on and the printing plane D corresponds to the predetermined, substantially constant printing angle. By adapting the speed with which the second drive moves the container reception means along the curved path, it is additionally possible to provide a constant surface speed of the print area to be printed on, perpendicular to the printing plane D.

Figure 5:
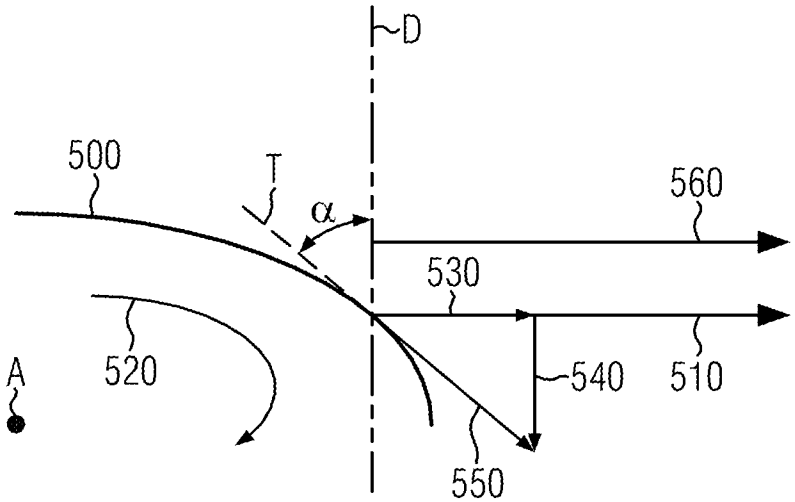
FIG. 5 shows, on the basis of a detailed view of the surface element to be printed on, the relevant speed vectors of the movement shown in FIG. 4.

FIG. 5 shows on the basis of a detailed view of the surface element to be printed on the relevant speed vectors of the movement shown in FIG. 4. Due to the rotary movement 520 of the container reception means about the axis of rotation A, a surface speed 550 is produced along the tangent T on the surface of the container 500 to be printed on at the point of intersection with the printing plane D. The surface speed 550 has a component 530 perpendicular to the printing plane D and a component 540 parallel to the printing plane D. The overall surface speed 560 perpendicular to the printing plane D is obtained by adding the speed 510 of the container reception means along the path, which penetrates the printing plane D perpendicular thereto in the case shown, to the perpendicular component 530 of the surface speed resulting from the rotary movement. As described above, a constant surface speed 560 perpendicular to the printing plane D can be realized by controlling by means of open-loop and/or closed-loop control the first and/or second drive, i.e. the linear and/or rotary movement of the container reception means.

Making reference to an elliptical horizontal printing cross-section, the determination of the angular speed of the rotary movement will here be demonstrated exemplarily. To make things easier, a perpendicular printing angle is assumed, so that the surface speed perpendicular to the printing plane D corresponds to the overall surface speed. In addition, the simplifying assumption is made that the speed of the axis of rotation in the printing plane D, i.e. due to the curvature of the path, by way of example, is negligible. In addition, the axis of rotation A is centrically positioned at the center of the ellipse.

A parameterization of an ellipse with semi-axes a and b in polar coordinates is given e.g. by $$r(\theta)=b/\sqrt{1-\epsilon^2\cos^2\theta} \tag{1}$$

with radius r and polar angle θ, where ϵ denotes the eccentricity of the ellipse.

For the infinitesimal surface element ds resulting from the rotary movement, the following holds true:

$$ds^2=dr^2+r^2d\theta^2. \tag{2}$$

A constant surface speed v=ds/dt, where t denotes the time, therefore requires:

$$v^2=\omega^2\left[r^2+\left(\frac{dr}{d\theta}\right)^2\right], \tag{3}$$

where ω denotes the angular speed of the rotary movement to be determined.

In total, $$\omega(\theta)=v\Big/\sqrt{r^2+\frac{\varepsilon^4}{b^4}r^6\sin^2\theta\cos^2\theta} \tag{4}$$

is thus obtained for ellipses as an angular speed ω as a function of the angle of rotation θ.

If the axis of rotation additionally moves with a speed $v_R$ perpendicular to the printing plane D, the surface speed v in equation (4) will have to be replaced by $v+v_R$.

On the other hand, starting from an angle of rotation θ, which is predetermined as a function of the position of the axis of rotation along the path, e.g. after predetermination of a specially curved path, so as to guarantee a substantially constant perpendicular printing angle, a speed profile of the movement of the container reception means along the path can be determined, which, as a function of the curvature of the path, guarantees a constant surface speed perpendicular to the printing plane D. The angular speed ω to be determined then results from the angle of rotation θ and the speed profile.

The signals required for generating the printing cycles can be transmitted to the print head either independently of the container surface movement or in dependence upon said movement. In the second case, printing cycles may also be transmitted in a speed-dependent manner, so that the resultant speed of the container surface need not be constant.

What is claimed is:

1. A device for direct printing on containers, comprising:

at least one printing unit including at least one print head;

a conveying system, which includes a plurality of container reception means arranged for rotation about an axis of rotation (A) and which is configured such that the container reception means circulate on a closed path and a print area of an outer surface of a container accommodated in a container reception means is movable past the print head for direct printing onto the print area; and at least one first drive adapted to rotate the container reception means, accommodating the container, about its axis of rotation (A) by means of at least one of open-loop or closed-loop control unit, the first drive being adapted to be variably controlled such that the print area is moved past the print head at a predetermined, substantially constant non-zero printing distance by controlled superposition of the rotary movement of the container reception means about its axis of rotation (A) and the circulation of the container reception means on the closed path.

2. The device according to claim 1, further comprising:

at least one second drive used for moving the container reception means along the closed path and configured such that the container reception means is moved past the print head with a predetermined speed.

3. The device according to claim 2, the predetermined speed of the container reception means being constant at least while the print area is printed on; and the first drive being at least one of open-loop controlled or closed-loop controlled by means of the at least one of open-loop or closed-loop control unit with respect to an angular speed of the container reception means and as a function of the predetermined constant speed of the container reception means such that a speed component of a surface element of the print area to be printed on perpendicular to a printing plane (D) of the print head is substantially constant during printing on the print area.

4. The device according to claim 2, in which during printing on the print area, the predetermined speed of the container reception means follows a speed profile, predetermined in accordance with a shape of the print area; and the first drive is at least one of open-loop controlled or closed-loop controlled by means of the at least one of open-loop or closed-loop control unit with respect to an angular speed of the container reception means and as a function of the predetermined speed profile of the container reception means such that a speed component of a surface element of the print area to be printed on perpendicular to a printing plane (D) of the print head is substantially constant during printing on the print area.

5. The device according to claim 3, wherein in the region of the print head, the closed path is curved such that a perpendicular distance between the axis of rotation (A) of the container reception means and the print head follows a profile, predetermined in accordance with a shape of the print area, in the region of the print head.

6. The device according to claim 5, the profile of the perpendicular distance being predetermined such that an angle of intersection of the print area with the printing plane (D) of the print head is substantially constant.

7. The device according to claim 6, the angle of intersection being constant within predetermined tolerance limits.

8. The device according to claim 6, the angle of intersection amounts to substantially 90°.

9. A method of direct printing on containers, which are conveyed by means of a plurality of container reception means of a conveying system defining a closed path, the container reception means being arranged for rotation about an axis of rotation (A), and the method comprising:

moving at least one container reception means along the closed path such that the container reception means is moved with a predetermined speed past a print head of a printing unit for direct printing onto the container, and rotating the container reception means about its axis of rotation (A) while moving the container reception means along the closed path such that a print area of an outer surface of a container accommodated in the container reception means is moved past the print head at a predetermined, substantially constant non-zero printing distance due to the superposition of the rotary movement of the container reception means about its axis of rotation (A) and the movement of the container reception means along the closed path.

10. The method according to claim 9, further comprising:

adapting a perpendicular distance between the axis of rotation (A) of the container reception means and the print head in the region of the print head according to a profile predetermined in accordance with a shape of the print area, while rotating the container reception means, such that an angle of intersection of the print area with a printing plane (D) of the print head is substantially constant.

11. The device according to claim 4, the speed profile being a non-constant speed profile.

12. The device according to claim 1, the printing unit configured as a stationary component.

13. The device according to claim 1, the substantially constant printing distance being a printing distance that is larger than or equal to a predetermined minimum printing distance and smaller than or equal to a predetermined maximum printing distance.

14. The device according to claim 3, and the speed component is constant within predetermined tolerance limits.

15. The device according to claim 3, wherein the closed path is straight at least in the region of the print head.

16. The device according to claim 1, the container reception means being configured such that the container can be accommodated in the container reception means eccentrically to the axis of rotation (A).

* * * * *